US009088082B2

(12) United States Patent
Katsui et al.

(10) Patent No.: US 9,088,082 B2
(45) Date of Patent: Jul. 21, 2015

(54) CONNECTOR

(71) Applicant: FUJITSU LIMITED, Kawasaki-shi, Kanagawa (JP)

(72) Inventors: Masayoshi Katsui, Machida (JP); Kazuya Orui, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 82 days.

(21) Appl. No.: 13/935,747

(22) Filed: Jul. 5, 2013

(65) Prior Publication Data

US 2014/0011406 A1 Jan. 9, 2014

(30) Foreign Application Priority Data

Jul. 6, 2012 (JP) ..... 2012-152903

(51) Int. Cl.

| | |
|---|---|
| ***H01R 24/00*** | (2011.01) |
| ***H01R 13/20*** | (2006.01) |
| ***H01R 13/631*** | (2006.01) |
| *H01R 13/04* | (2006.01) |
| *H01R 13/405* | (2006.01) |
| *H01R 24/62* | (2011.01) |

(52) U.S. Cl.

CPC ..... *H01R 13/20* (2013.01); *H01R 13/631* (2013.01); *H01R 13/04* (2013.01); *H01R 13/405* (2013.01); *H01R 24/62* (2013.01)

(58) Field of Classification Search

CPC ..... H01R 23/7073
USPC ..... 439/660, 862
See application file for complete search history.

(56) References Cited

U.S. PATENT DOCUMENTS

| | | | | |
|---|---|---|---|---|
| 6,227,882 | B1 | 5/2001 | Ortega et al. | |
| 7,682,199 | B2 * | 3/2010 | Ahn et al. | 439/660 |
| 8,215,997 | B2 * | 7/2012 | Hsia | 439/660 |
| 2008/0280465 | A1 | 11/2008 | Ahn et al. | |

FOREIGN PATENT DOCUMENTS

| | | | |
|---|---|---|---|
| JP | 11-195462 | A | 7/1999 |
| JP | 2003-123908 | A | 4/2003 |
| JP | 2008-277225 | A | 11/2008 |

* cited by examiner

*Primary Examiner* — Phuong Dinh
(74) *Attorney, Agent, or Firm* — Squire Patton Boggs (US) LLP

(57) ABSTRACT

A connector includes: a plurality of connecting terminals; a resin connecting portion, formed in a protruded shape, configured to hold the plurality of connecting terminals; and a metal protecting portion, formed integrally with one of the plurality of connecting terminals and provided on a side surface of the connecting portion, configured to cover at least a part of the side surface of the connecting portion closest to the distal end portion of the connecting portion.

16 Claims, 9 Drawing Sheets

CONNECTOR

CROSS-REFERENCE TO RELATED APPLICATION

This application is based upon and claims the benefit of priority of the prior Japanese Patent Application No. 2012-152903, filed on Jul. 6, 2012, the entire contents of which are incorporated herein by reference.

FIELD

The embodiments discussed herein are related to a connector.

BACKGROUND

A connector includes a connecting terminal and a connecting portion that holds this connecting terminal.

A related art is disclosed in Japanese Laid-open Patent Publication No. 11-195462 or Japanese Laid-open Patent Publication No. 2003-123908.

SUMMARY

According to one aspect of the embodiments, a connector includes: a plurality of connecting terminals; a resin connecting portion, formed in a protruded shape, configured to hold the plurality of connecting terminals; and a metal protecting portion, formed integrally with one of the plurality of connecting terminals and provided on a side surface of the connecting portion, configured to cover at least a part of the side surface of the connecting portion closest to the distal end portion of the connecting portion.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

In a connector including a connecting terminal and a connecting portion that holds the connecting terminal, for example, a mating connector may be coupled from an oblique direction, or a mating connector may be pulled out while being shaken up and down or from side to side. In this case, the mating connector may damage the connecting portion.

Figure 1:
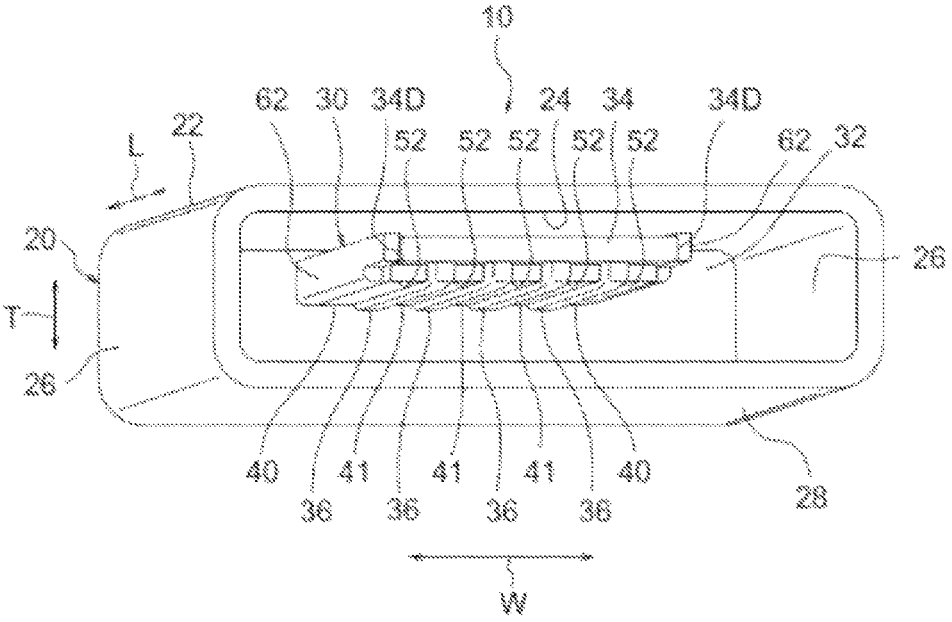
FIG. 1 illustrates an example of a connector.

FIG. 1 illustrates an example of a connector. The connector 10 illustrated in FIG. 1 may be used, for example, as a connector corresponding to an interface standard. Standards may include Universal Serial Bus (Mini USB), Micro USB, Micro High-Definition Multimedia Interface (HDMI), or Types A to D.

The connector 10 may be used as a connector other than a connector corresponding to a standard. The connector 10 includes a connector case 20, a resin member 30, and a plurality of terminal members 40 and 41.

The connector case 20 may be formed, for example, of a conductive metal such as aluminum alloy. The connector case 20 has an annular portion 22 that is substantially rectangular in front view, and an opening 24 is formed in the front portion of the annular portion 22. The opening 24 is open in the direction in which the connector 10 is inserted and pulled out, for example, the depth direction of the connector case 20 and the L direction.

Figure 2:
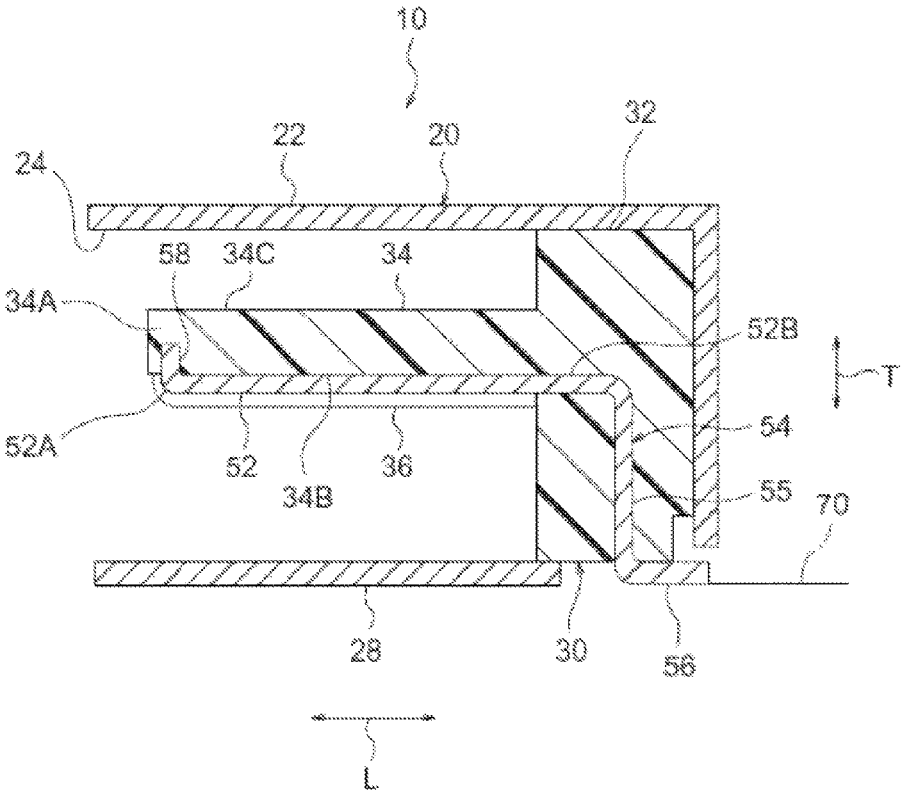
FIG. 2 illustrates an example of a side sectional view of the connector.
Figure 3:
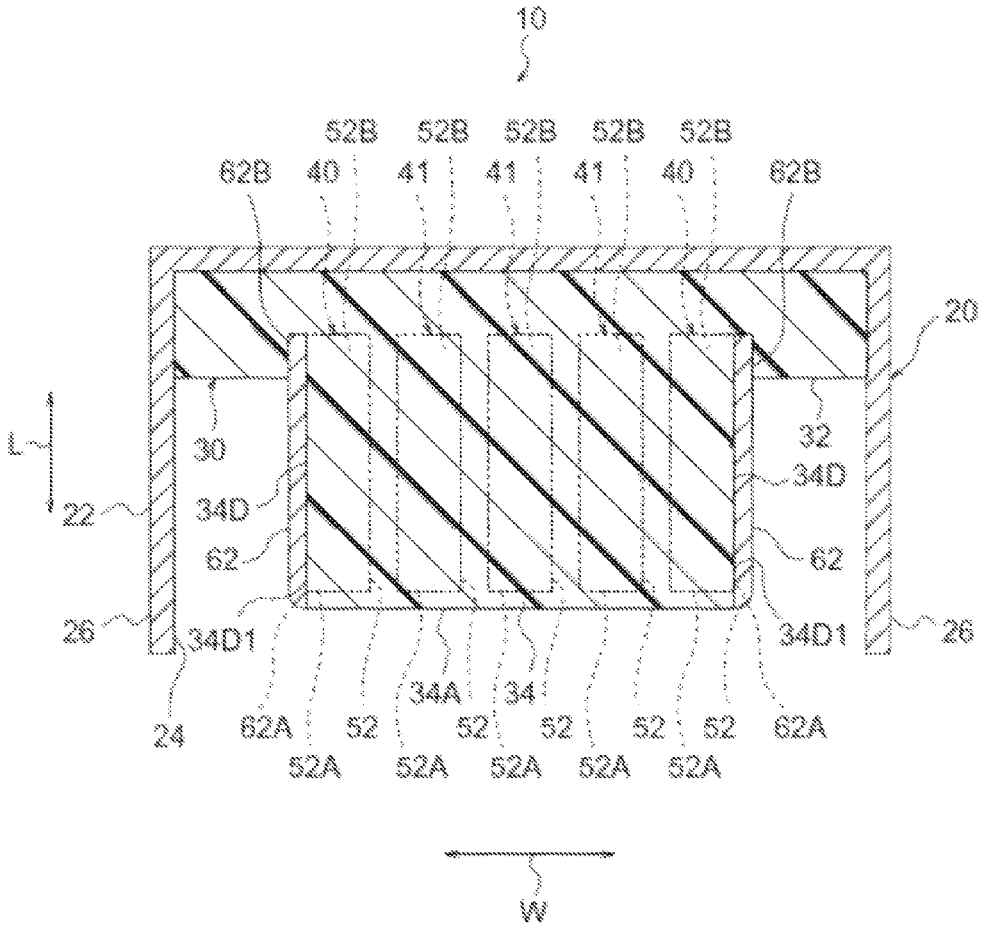
FIG. 3 illustrates an example of a plan sectional view of the connector.

For example, the resin member 30 may be integrated with the plurality of terminal members 40 and 41 (plurality of connecting terminals 52) by resin mold forming (insert forming). The resin member 30 includes a resin main body portion 32 and a connecting portion 34. FIG. 2 illustrates an example of a side sectional view of the connector. FIG. 3 illustrates an example of a plan sectional view of the connector. The connector illustrated in FIG. 2 and FIG. 3 is the connector illustrated in FIG. 1. As illustrated in FIG. 2 or FIG. 3, the resin main body portion 32 has an outer shape that is substantially identical or similar to the inner periphery of the annular portion 22, and is placed within the annular portion 22 in close contact with the inner periphery of the annular portion 22. The resin main body portion 32 is fixed to a part of the annular portion 22 on the back side (on the side opposite to the opening 24), by a fitting portion or the like.

The connecting portion 34 is formed in a protruded shape, and protrudes from the resin main body portion 32 toward the opening 24 of the connector case 20. As illustrated in FIG. 1, the connecting portion 34 is formed in a rectangular shape in front view whose longitudinal direction is the width direction of the connector case 20, for example, the W direction. The connecting portion 34 has an outer shape that is smaller than the inner periphery of the connector case 20, and a space is provided between the outer periphery of the connecting portion 34 and the inner periphery of the annular portion 22. The connecting portion 34 has partition portions 36 formed between the plurality of connecting terminals 52. The partition portions 36 extend in the direction in which the connecting portion 34 protrudes, for example, the L direction).

The plurality of terminal members 40 and 41 may be formed, for example, of a conductive metal such as copper. The plurality of terminal members 40 and 41 each have a connecting terminal 52. The plurality of connecting terminals 52 may be arranged side by side at intervals in the width direction of the connecting portion 34, for example, the W direction. Each connecting terminal 52 is formed like a plate whose thickness direction is the thickness direction of the connecting portion 34, for example, the T direction, and extends in the direction in which the connecting portion 34 protrudes. As illustrated in FIG. 2, each connecting terminal 52 is held by the connecting portion 34 so as to be placed on one 34B of the surfaces of the connecting portion 34 in the thickness direction.

Figure 4:
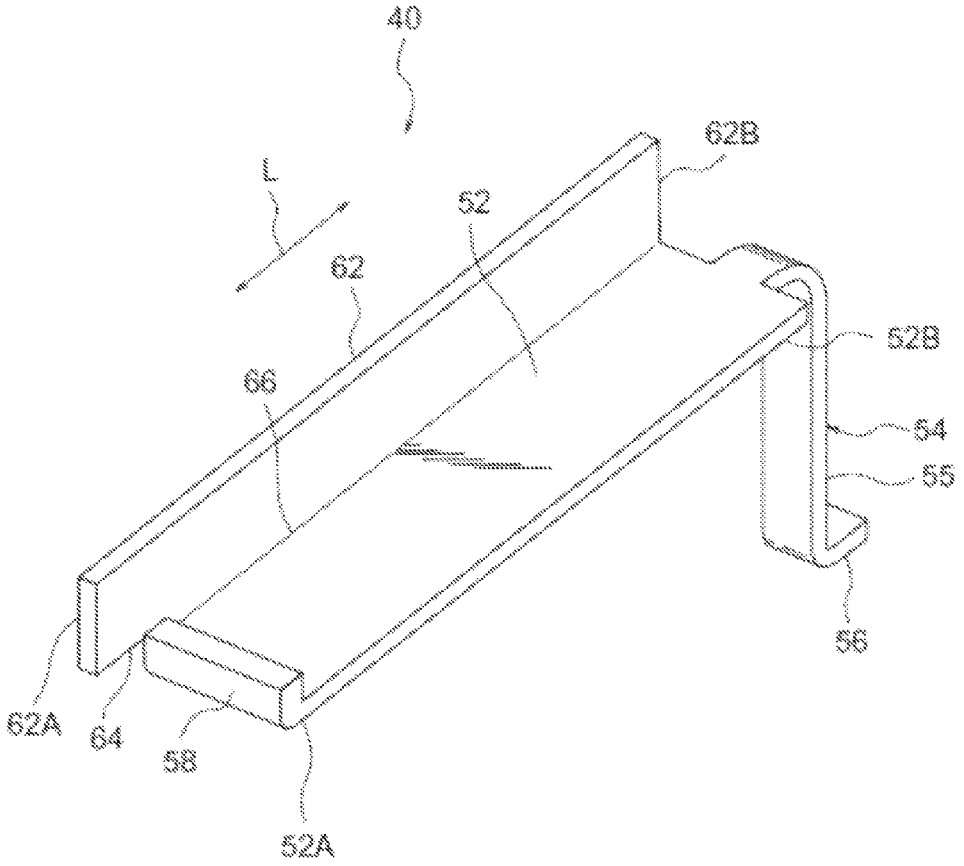
FIG. 4 illustrates an example of a perspective view of a terminal member.
Figure 5:
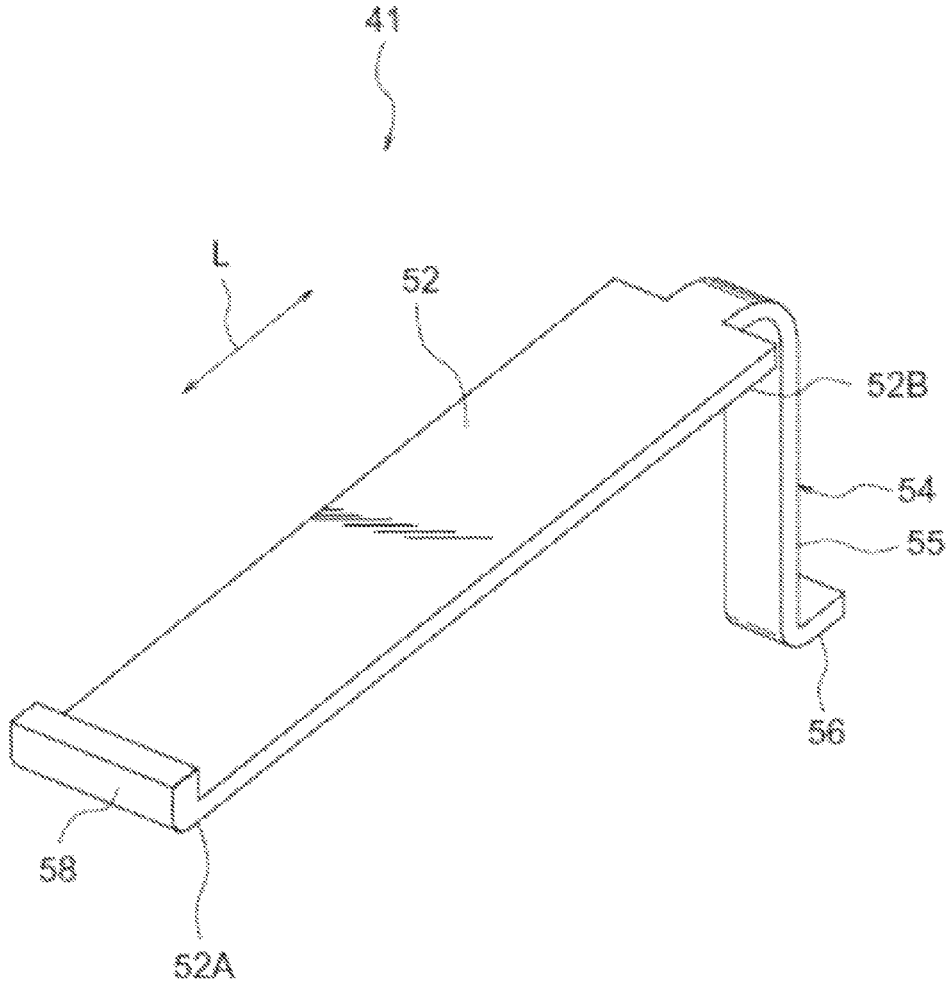
FIG. 5 illustrates an example of a perspective view of a terminal member.

FIG. 4 and FIG. 5 each illustrate an example of a perspective view of a terminal member. FIG. 4 illustrates a perspective view of a terminal member that has a protecting portion.

FIG. 5 illustrates a perspective view of a terminal member that does not have a protecting portion. As illustrated in FIG. 4 or FIG. 5, a fixing portion 58 is formed in each of the distal end portions 52A of the plurality of connecting terminals 52. As illustrated in FIG. 2, the fixing portions 58 are bent toward the other 34C of the surfaces of the connecting portion 34 in the thickness direction. The fixing portions 58 are embedded in the distal end portion 34A of the connecting portion 34, and the distal end portions 52A of the connecting terminals 52 are thereby fixed to the distal end portion 34A of the connecting portion 34. As illustrated in FIG. 3, the proximal end portions 52B of the plurality of connecting terminals 52 are embedded in the resin main body portion 32 and thereby fixed to the resin main body portion 32.

As illustrated in FIG. 4 or FIG. 5, a leg portion 54 is formed in the proximal end portion 52B of each connecting terminal 52. The leg portion 54 has a hanging portion 55 and a connecting piece 56. As illustrated in FIG. 2, the hanging portion 55 extends from the proximal end portion 52B of the connecting terminal 52 toward the bottom wall portion 28 of the connector case 20. The connecting piece 56 extends from the distal end portion of the hanging portion 55 toward the side opposite to the opening 24 of the connector case 20. The connecting piece 56 may be soldered to a conductive part of the board 70.

As illustrated in FIG. 1, the connecting terminals 52 disposed at both outer ends of the plurality of connecting terminals 52 (the connecting terminals 52 of the terminal members 40) each have a protecting portion 62 formed integrally therewith. One of the terminal members 40 that is provided on one of the side surfaces 34D of the connecting portion 34 and that has a protecting portion 62 is formed symmetrically in the width direction of the connecting portion 34, for example, the W direction to the other of the terminal members 40 that is provided on the other of the side surfaces 34D of the connecting portion 34 and that has a protecting portion 62. Therefore, one of the terminal members 40 will be described, and the description of the other of the terminal members 40 may be omitted.

The protecting portions 62 are each formed like a plate whose thickness direction is the width direction of the connecting portion 34, and extend in the direction in which the connecting portion 34 protrudes. The connecting terminal 52 and the protecting portion 62 formed in one of the terminal members 40 form an L-shape in cross-section as viewed along the direction in which the connecting portion 34 protrudes (see FIG. 4). The protecting portion 62 is provided on the side surface 34D of the connecting portion 34 and may cover the entire side surface 34D. The entire side surface 34D may include substantially the entire side surface 34D. For example, the entire side surface 34D may be slightly smaller than the side surface 34D. The protecting portion 62 faces the side wall portion 26 of the connector case 20, with a space therebetween.

Figure 6:
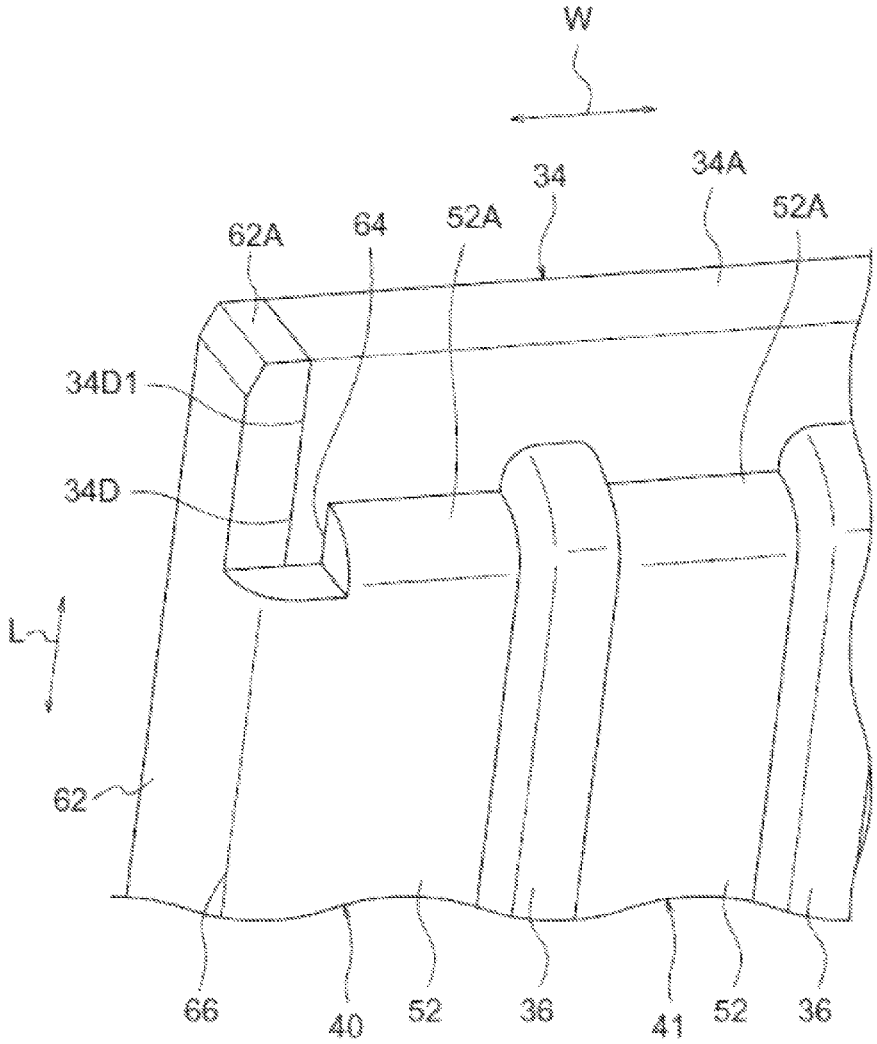
FIG. 6 illustrates an example of an enlarged perspective view of a protecting portion and the surrounding area thereof.

As illustrated in FIG. 3, the distal end portion 62A of the protecting portion 62 reaches the distal end portion 34A of the connecting portion 34. On the other hand, as with the proximal end portion 52B of the connecting terminal 52, the proximal end portion 62B of the protecting portion 62 is embedded in the resin main body portion 32 and thereby fixed to the resin main body portion 32. FIG. 6 illustrates an example of an enlarged perspective view of the protecting portion and the surrounding area thereof. For example, the protecting portion and the surrounding area thereof illustrated in FIG. 6 may be the protecting portion and the surrounding area thereof illustrated in FIG. 1. As illustrated in FIG. 6, the distal end portion 62A of the protecting portion 62 protrudes closer to the distal end portion 34A of the connecting portion 34 than the distal end portions 52A of the plurality of connecting terminals 52.

In one of the terminal members 40, a cutout 64 extending toward the proximal end portion 52B of the connecting terminal 52 is formed between the distal end portion 62A of the protecting portion 62 and the distal end portion 52A of the connecting terminal 52. As illustrated in FIG. 4, a bent portion 66 is formed between the cutout 64 and the proximal end portions 52B and 62B of the connecting terminal 52 and the protecting portion 62. The connecting terminal 52 and the protecting portion 62 are coupled by the bent portion 66.

The terminal members 40 are formed in a three-dimensional shape by forming a flat member having parts corresponding to the connecting terminal 52, the leg portion 54, the fixing portion 58, and the protecting portion 62 by punching and then bending the flat member. Similarly, the other terminal members 41 illustrated in FIG. 5 are formed in a three-dimensional shape by forming a flat member having parts corresponding to the connecting terminal 52, the leg portion 54, and the fixing portion 58 by punching and then bending the flat member.

Figure 7:
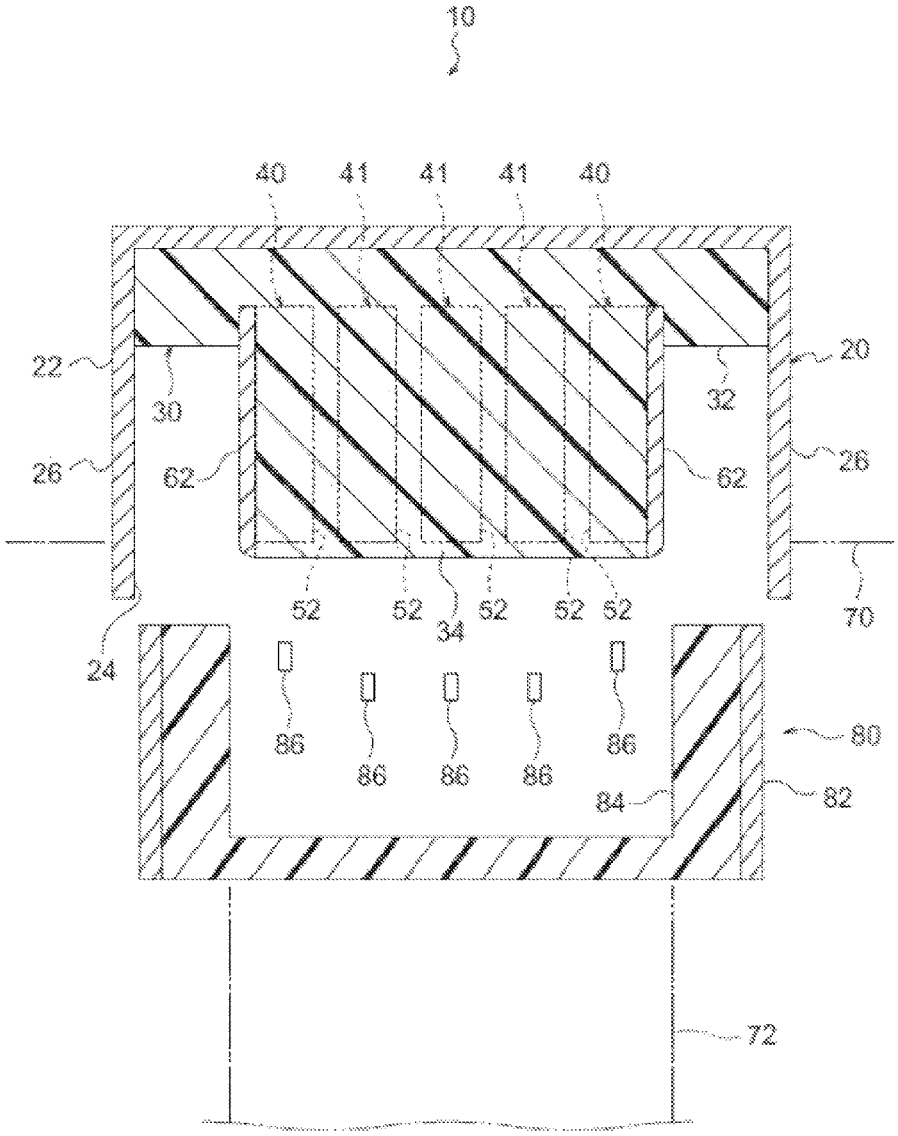
FIG. 7 illustrates an example of a plan sectional view of the connector.

FIG. 7 illustrates an example of a plan sectional view of the connector. In FIG. 7, a mating connector is coupled to the connector illustrated in FIG. 1 from a straight direction. As illustrated in FIG. 7, the connector 10, which is mounted on a board 70, is coupled with a mating connector, for example, a cable 72 side connector 80. The mating connector 80 includes a connector case 82, a connecting portion 84 provided inside the connector case 82, and a plurality of connecting terminals 86. The connecting portion 84 is formed in a recessed shape, and the protruded connecting portion 34 is inserted into the inside of the recessed connecting portion 84 and coupled with the connecting portion 84. When the connecting portion 34 and the connecting portion 84 are coupled, the plurality of connecting terminals 52 are in contact with the plurality of connecting terminals 86.

Figure 8:
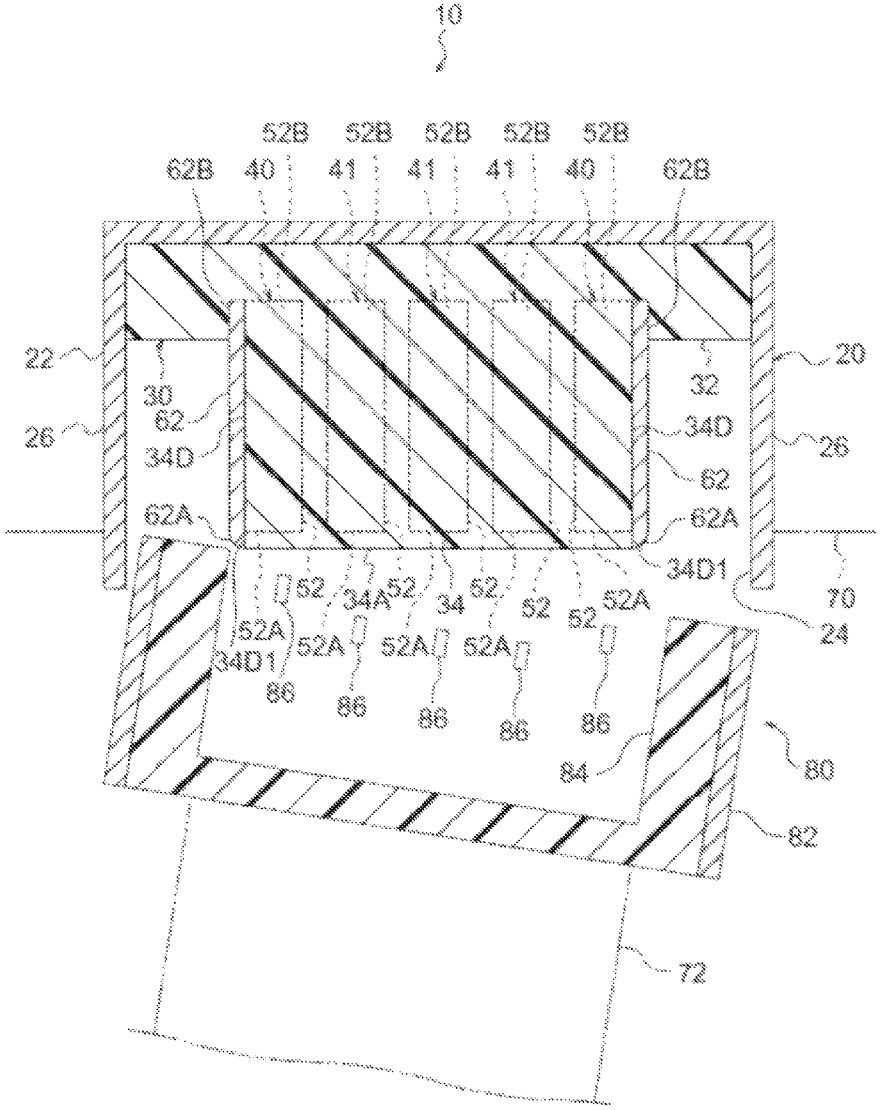
FIG. 8 illustrates an example of a plan sectional view of the connector.

FIG. 8 illustrates an example of a plan sectional view of the connector. In FIG. 8, a mating connector is coupled to the connector illustrated in FIG. 1 from an oblique direction. As illustrated in FIG. 8, the mating connector 80 may be coupled to the connector 10 from an oblique direction, or the mating connector 80 may be pulled out of the connector 10 while being shaken up and down or from side to side.

According to the connector 10, a metal protecting portion 62 that covers the side surface 34D of the connecting portion 34 is provided on the side surface 34D of the connecting portion 34. Therefore, if the mating connector 80 is coupled from an oblique direction or pulled out while being shaken, the side surface 34D of the connecting portion 34 may be protected by the metal protecting portion 62. The damage to the side surface 34D of the connecting portion 34 caused by the mating connector 80 is reduced, and therefore the damage to the connecting portion 34 is reduced.

The protecting portion 62 covers a part 34D1 of the side surface 34D of the connecting portion 34 closest to the distal end portion 34A. If the mating connector 80 is coupled from an oblique direction or pulled out while being shaken from side to side, the part 34D1 may be damaged by the mating connector 80. Therefore, the part 34D1 may be appropriately protected by the protecting portion 62.

Since the protecting portion 62 covers the entire side surface 34D of the connecting portion 34, the entire side surface 34D of the connecting portion 34 may also be protected.

The protecting portion 62 is formed integrally with the connecting terminal 52 of the terminal member 40. Therefore, the number of components may be reduced.

The connecting terminal 52 of the terminal member 40 in which the protecting portion 62 is formed may be disposed at the outer end of the plurality of connecting terminals 52. Since the connecting terminal 52 and the protecting portion 62 are adjacent to each other, the configuration of the terminal member 40 having the connecting terminal 52 and the protecting portion 62 may be simplified.

In the terminal member 40, the connecting terminal 52 and the protecting portion 62 form an L-shape in cross-section as viewed along the direction in which the connecting portion 34 protrudes (see FIG. 4). Since the terminal member 40 having the connecting terminal 52 and the protecting portion 62 is in close contact with the connecting portion 34 in two surfaces of the connecting terminal 52 and the protecting portion 62, the close contact between the terminal member 40 and the connecting portion 34 may be secured.

When the connecting terminal 52 and the protecting portion 62 of the terminal member 40 form an L-shape in cross-section, the rigidity of the protecting portion 62 may be improved. The protection of the connecting portion 34 may be improved.

The proximal end portions 52B and 62B of the connecting terminal 52 and the protecting portion 62 formed in the terminal member 40 are embedded in the resin main body portion 32 and fixed to the resin main body portion 32. As illustrated in FIG. 2, the fixing portion 58 formed in the distal end portion 52A of the connecting terminal 52 is embedded in the distal end portion 34A of the connecting portion 34, and the distal end portion 52A of the connecting terminal 52 is thereby fixed to the distal end portion 34A of the connecting portion 34. Therefore, the terminal member 40 having the connecting terminal 52 and the protecting portion 62 may be firmly fixed to the connecting portion 34.

FIG. 8 illustrates an example of a plan sectional view of the connector. In FIG. 8, a mating connector is coupled to the connector illustrated in FIG. 1 from an oblique direction. As illustrated in FIG. 8, the distal end portion 62A of the protecting portion 62 protrudes closer to the distal end portion 34A of the connecting portion 34 than the distal end portions 52A of the plurality of connecting terminals 52. Therefore, when the mating connector 80 is coupled to the connector 10 from an oblique direction, the damage to the side surface 34D of the connecting portion 34 caused by the mating connector 80 may be reduced before the plurality of connecting terminals 52 are coupled to the plurality of connecting terminals 86.

The protecting portion 62 may be formed so as to cover the entire side surface 34D of the connecting portion 34. The protecting portion 62 may be formed so as to cover only a part 34D1 of the side surface 34D of the connecting portion 34 closest to the distal end portion 34A. For example, the protecting portion 62 may be formed so as to cover at least the part 34D1 of the side surface 34D of the connecting portion 34 closest to the distal end portion 34A.

The protecting portion 62 may be formed integrally with the connecting terminal 52 of the terminal member 40, or may be formed separately from the connecting terminal 52.

The connector 10 may include the connector case 20, or may not include the connector case 20.

The protecting portion 62 may be formed integrally with the outermost one of the plurality of connecting terminals 52. The protecting portion 62 may be formed integrally with a connecting terminal 52 other than the outermost connecting terminal 52, for example, the connecting terminal 52 of the terminal member 41.

The connecting portion 34 may be integrated with a plurality of terminal members 40 and 41, for example, a plurality of connecting terminals 52 by mold forming (insert forming). For example, the connecting portion 34 may be integrated with a plurality of terminal members 40 and 41 after being molded from resin separately from the plurality of terminal members 40 and 41.

The protecting portion 62 may be provided on each side surface 34D of the connecting portion 34, or the protecting portion 62 may be provided on only one of the side surfaces 34D of the connecting portion 34.

Figure 9:
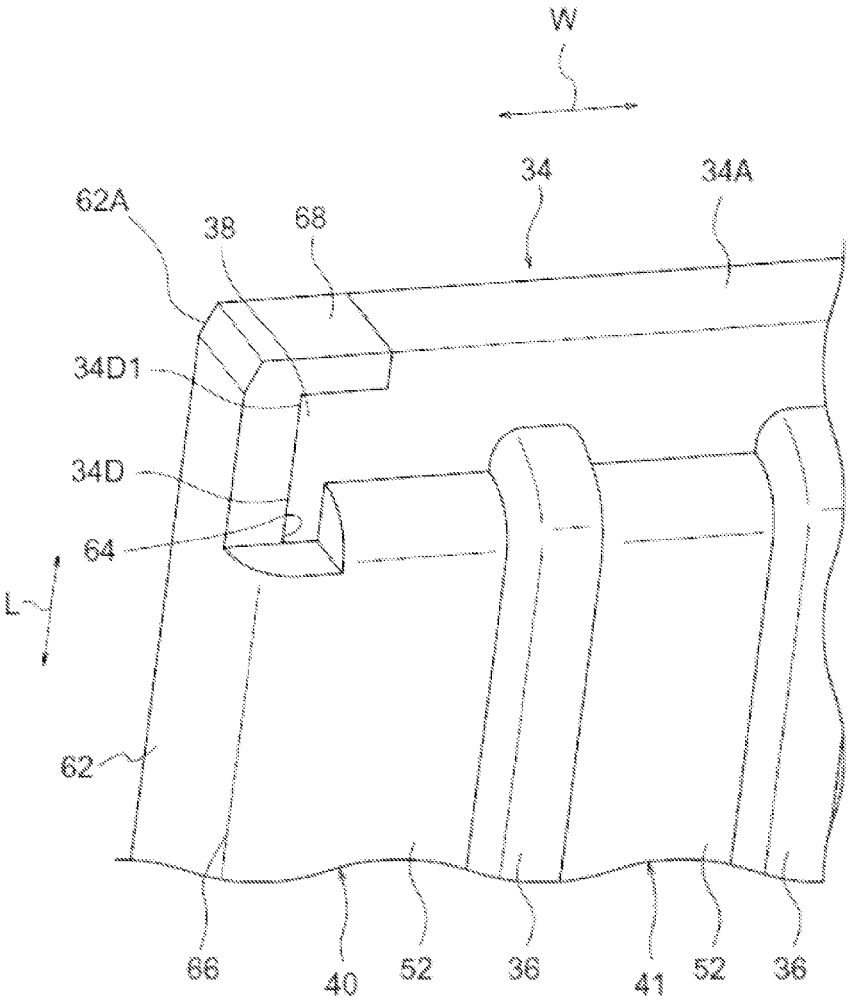
FIG. 9 illustrates an example of a connector.

FIG. 9 illustrates an example of a connector. In FIG. 9, a partially enlarged perspective view of a connector is illustrated. The connector illustrated in FIG. 9 may have components that are substantially identical or similar to the components illustrated in FIG. 1. As illustrated in FIG. 9, a bent portion 68 that is bent toward the inner side in the width direction of the connecting portion 34 may be formed in the distal end portion 62A of the protecting portion 62. The corner portion 38 of the connecting portion 34 closest to the distal end portion 34A may be protected by the bent portion 68 and the protecting portion 62.

As illustrated in FIG. 7, the connector 10 may be mounted on a board 70, and the mating connector 80 may be coupled to a cable 72. The connector 10 may be coupled to a cable 72, and the mating connector 80 may be mounted on a board 70.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A connector comprising:

a plurality of connecting terminals;

a resin connecting portion, formed in a protruded shape, configured to hold the plurality of connecting terminals; and a metal protecting portion, formed integrally with one of the plurality of connecting terminals and provided on a side surface of the connecting portion, configured to cover at least a part of the side surface of the connecting portion closest to the distal end portion of the connecting portion.

2. The connector according to claim 1, wherein the plurality of connecting terminals are arranged side by side in the width direction of the connecting portion, and the one of the plurality of connecting terminals is the outermost one of the plurality of connecting terminals.

3. The connector according to claim 2, wherein the one of the plurality of connecting terminals and the protecting portion form an L-shape in cross-section as viewed along the direction in which the connecting portion protrudes.

4. The connector according to claim 3, wherein the one of the plurality of connecting terminals is formed in plate shape whose thickness direction is the thickness direction of the connecting portion, and the protecting portion is formed in a plate shape whose thickness direction is the width direction of the connecting portion.

5. The connector according to claim 3, further comprising:

a connector case; and a resin main body portion fixed to the connector case, wherein the connecting portion protrudes from the resin main body portion, the one of the plurality of connecting terminals and the protecting portion extend along the direction in which the connecting portion protrudes, the proximal end portions of the one of the plurality of connecting terminals and the protecting portion are fixed to the resin main body portion, and the distal end portion of the one of the plurality of connecting terminals is fixed to the distal end portion of the connecting portion.

6. The connector according to claim 5, wherein the proximal end portions of the one of the plurality of connecting terminals and the protecting portion are embedded in the resin main body portion, a fixing portion is formed by bending in the distal end portion of the one of the plurality of connecting terminals, and the distal end portion of the one of the plurality of connecting terminals is fixed to the distal end portion of the connecting portion by embedding the fixing portion in the distal end portion of the connecting portion.

7. The connector according to claim 1, wherein the protecting portion covers the entire side surface of the connecting portion.

8. The connector according to claim 1, wherein the distal end portion of the protecting portion is protruded closer to the distal end portion of the connecting portion than the distal end portions of the plurality of connecting terminals.

9. The connector according to claim 1, wherein a bent portion that is bent toward the inner side in the width direction of the connecting portion is formed in the distal end portion of the protecting portion.

10. The connector according to claim 1, wherein the connecting portion is integrated with the plurality of connecting terminals by resin mold forming.

11. The connector according to claim 1, wherein the protecting portion is provided on each side surface of the connecting portion.

12. The connector according to claim 11, wherein one of terminal members that is provided on one of the side surfaces of the connecting portion and that has the protecting portion is formed symmetrically in the width direction of the connecting portion to the other of the terminal members that is provided on the other of the side surfaces of the connecting portion and that has the protecting portion.

13. The connector according to claim 1, wherein the protecting portion is provided on only one of both side surfaces of the connecting portion.

14. The connector according to claim 1, wherein the protecting portion is formed integrally with the one of the plurality of connecting terminals, and a terminal member having the one of the plurality of connecting terminals and the protecting portion is formed in a three-dimensional shape by forming a flat member having parts corresponding to the one of the plurality of connecting terminals and the protecting portion by punching and bending the flat member.

15. The connector according to claim 1, wherein the connector corresponds to the standard of one of Mini Universal Serial Bus (USB), Micro USB, Micro High-Definition Multimedia Interface (HDMI), and Types A to D.

16. A connector comprising:

a connector case;

a resin connecting portion, formed in a protruded shape and placed in the connector case, configured to hold a plurality of connecting terminals; and a metal protecting portion, provided on a side surface of the connecting portion and opposite to a side wall portion of the connecting portion with a space, configured to cover at least a part of the side surface of the connecting portion closest to the distal end portion of the connecting portion, wherein the protecting portion is formed integrally with one of the plurality of connecting terminals.

* * * * *